US005628460A

United States Patent [19]

Chastang et al.

[11] Patent Number: 5,628,460

[45] Date of Patent: May 13, 1997

[54] DEVICE FOR LINEAR SPRAYING OF A LIQUID PARTICULARLY A COOLING LIQUID

[75] Inventors: Georges Chastang, Maurepas; Michel M. J. Chiron, Mareil-Marly, both of France

[73] Assignee: Bertin & Cie, Des Gatines Plaisir, France

[21] Appl. No.: 397,255

[22] PCT Filed: Sep. 16, 1993

[86] PCT No.: PCT/FR93/00891

§ 371 Date: Mar. 14, 1995

§ 102(e) Date: Mar. 14, 1995

[87] PCT Pub. No.: WO94/06569

PCT Pub. Date: Mar. 31, 1994

[30] Foreign Application Priority Data

Sep. 18, 1992 [FR] France ..... 92 11164

[51] Int. Cl.[6] ..... B05B 7/04; B05B 1/14

[52] U.S. Cl. ..... 239/433; 239/568; 239/590.5; 261/78.2

[58] Field of Search ..... 239/418, 419, 239/423, 424, 424.5, 427, 427.3, 433, 568, 590, 590.5, 597; 261/78.2

[56] References Cited

U.S. PATENT DOCUMENTS 4,903,895 2/1990 Mathewson et al. ..... 239/433 X 5,012,980 5/1991 Viannay et al. ..... 239/423

5,118,041 6/1992 Chastang et al. ..... 239/424

FOREIGN PATENT DOCUMENTS 430980 10/1911 France .

533308 2/1922 France ..... 239/433

1527250 5/1968 France .

4110127 10/1992 Germany ..... 239/568

*Primary Examiner*—Lesley D. Morris

*Attorney, Agent, or Firm*—Watson Cole Stevens Davis, P.L.L.C.

[57] ABSTRACT

A device for linear spraying of a liquid includes a series of tubes ($3_1$) which supply liquid from a supply pipe (4) to an elongated spray nozzle (7) in the wall of a chamber (1) and a pipe (2) for delivering gas to the chamber to drive the liquid out of the enclosure. An elongate element (5) is provided in the enclosure to receive the liquid from the feed means. The liquid is spread over a convex surface ($5_1$) of the element and is then carried off by the gas and flows to two elongate slits ($8_1$,$8_2$) adjacent to the nozzle (7) and converging towards the latter. The width of these slits varies periodically and interdependently over their length to form two sheets of the liquid/gas mixture which come together at the nozzle (7) to form at its outlet a mist of liquid confined within an angle ($\alpha$) from the nozzle.

11 Claims, 1 Drawing Sheet

DEVICE FOR LINEAR SPRAYING OF A LIQUID PARTICULARLY A COOLING LIQUID

Figure 1:
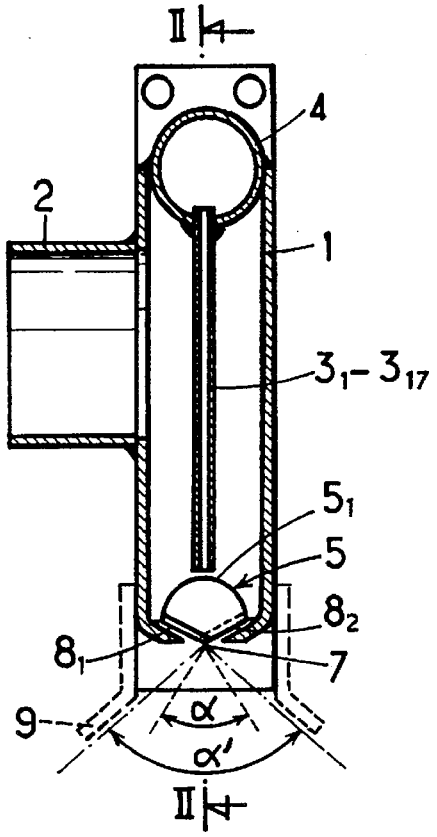

The present invention relates to a device for spraying a liquid and, more particularly, to such a linear device designed for the linear spraying of a cooling liquid onto hot objects such as blooms obtained at the exit of a rolling mill or a continuous casting unit in the iron and steel industry.

A need has been expressed in this industry for linear cooling-water spray units arranged perpendicular to the direction of advance of the bloom and parallel to the faces of the latter so as to spray them with this water. It has also been indicated that said linear spray units should each be able to cover the largest possible area so as thus to limit the number of them and the associated maintenance problems, such as the upkeep of a plumbing system whose complexity increases with the number of spray units to be fed, and to simplify the control of the flow rates by limiting the number of valves.

It is possible to imagine forming such a spray unit with a set of aligned cylindrical tubes fed with cooling water. It is known that the angle of spread of the water thus sprayed at the outlet of the tube is a function of the geometry of the nozzles placed at the end of the tubes; this leads to a cooling uniformity which is deemed to be insufficient in the application mentioned.

It is also possible to imagine using linear spray units with slits, such as the one described in the International Patent Application WO 89/10203 filed in the name of the Applicant Company. With very thin slits, for example of the order of 0.2 mm, and with very smooth walls, an angle of spread of approximately 90° is achieved, which would be satisfactory in the application envisaged hereinabove. Unfortunately, in iron- and steel-making, the use of a spray unit with a slit of 0.2 mm in width cannot be envisaged because of the quality of the water used, this being laden with hard particles which would rapidly clog such a slit. The minimum admissible slit width is 1 mm and, with such a slit width, the angle of spread of the sprayed water is only 30° approximately, this being insufficient to satisfy the condition mentioned hereinabove of covering a large area.

Furthermore, it is desirable to be able to vary the flow rate of sprayed water over a wide range of flow rates. With the known spray units or atomizers, the variation ratio reaches 3 or 4 at the most, whereas a ratio greater than 10 would be desirable in iron- and steel-making so that identical, and therefore interchangeable, spray units could be used at various points requiring cooling with different intensities, these being adjusted by controlling the water flow rate of the spray units.

The object of the present invention is therefore to produce a device for linear spraying of a liquid, especially a cooling liquid, which makes it possible to achieve wide spray angles without having recourse to spray slits with a width less than one millimeter.

The object of the present invention is also to produce such a spray device having a large variation ratio, typically greater than 10, of the flow rate of liquid sprayed.

These objects of the invention, together with others which will appear on reading the following description, are achieved with a device for linear spraying of a liquid, especially a cooling liquid, of the type which comprises means, arranged in a chamber, for supplying the liquid to an elongate spray nozzle formed in the wall of the chamber and means for injecting a gas into this chamber in order to spray the liquid supplied to the nozzle and to carry it away out of the chamber. According to the invention, the device comprises an elongate component arranged in the chamber so as to be sprayed by the liquid leaving the means for supplying the liquid, which will then spread out over a convex surface of this component in order to be carried away by the gas and to flow out towards two elongate slits adjacent to the nozzle and converging in the latter, the width of the slits varying periodically and complementarily along their length so as to delimit two sheets of the liquid/gas mixture which interpenetrate in the region of the nozzle, forming, at the outlet of the latter, a liquid mist confined within a dihedron opening out from the nozzle.

By virtue of this component and of these slits, it is possible, as will be seen below, to achieve aperture angles of this dihedron reaching 60° and even 90°, with slits and a nozzle of width never less than 1 mm, in accordance with the condition imposed by the iron and steel industry.

According to a particular embodiment of the device according to the invention, each slit is delimited by an internal wall part of the chamber and a surface of the elongate component arranged opposite and which extends one end of the convex surface of this component, the two surfaces of the elongate component which each delimit one slit intersecting in the region of the spray nozzle. These surfaces are hollowed out with notches uniformly distributed along the entire length of the spray nozzle, the notches of one surface being longitudinally offset from the notches of the other surface. The notches, along the longitudinal axis of the elongate component, have a fixed width equal to that of the surface elements separating them, the notches of one of the surfaces being offset from the notches of the other surface by the width of these surface elements.

As will be seen later, it is by virtue of this arrangement that two sheets of liquid/gas mixture passing into the slits can interpenetrate in the region of the spray nozzle so as to maintain a maximum aperture at the dihedron into which this nozzle sprays the sprayed liquid.

Figure 2:
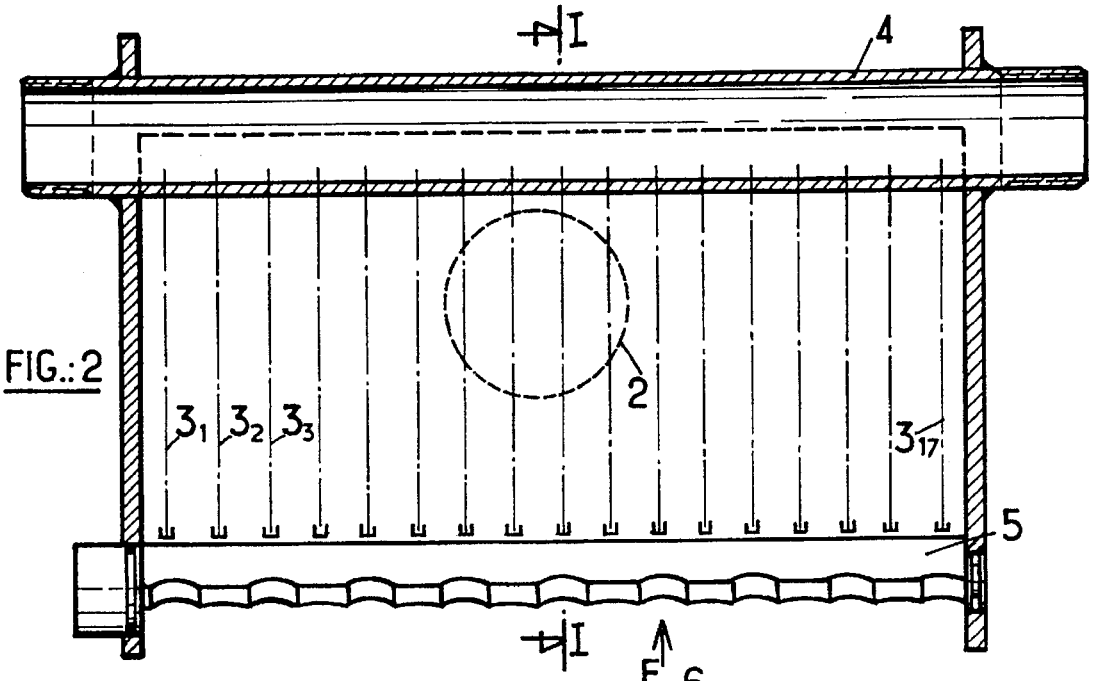
Figure 3:
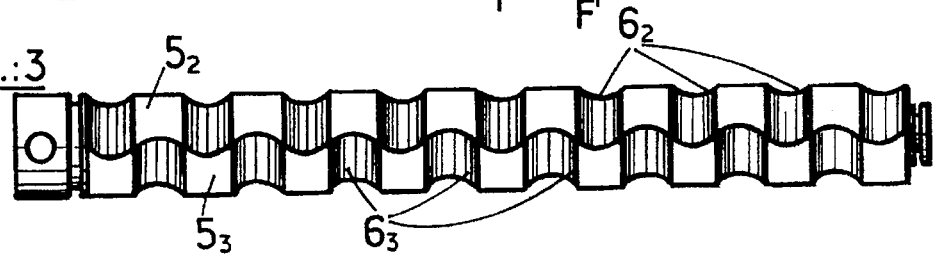

Other characteristics and advantages of the present invention will appear on reading the following description and on examining the appended drawing in which:

FIG. 1 is a cross-sectional view of the linear spray device according to the present invention, FIG. 2 is a longitudinal sectional view along the line of section II—II of FIG. 1, and FIG. 3 is a view of the elongate component, forming part of the device according to the invention, seen along the arrow F of FIG. 2.

Referring to FIGS. 1 to 3 of the appended drawing, it is apparent that the device according to the invention comprises a generally parallelepipedal chamber 1 which communicates with a source (not depicted) of a gas, such as air, via a pipe 2. In the chamber 1 are found means for supplying a liquid which are constituted by a series of tubes $\mathbf{3}_1$ to $\mathbf{3}_{17}$ mounted parallel to each other and perpendicular to a liquid supply pipe 4 connected to a source (not depicted) of such a liquid. Incidentally, it will be noted that, advantageously, the pipe 4 serves to close off one face of the chamber 1 onto which it is fixed by weld beads, for example.

As is apparent in FIG. 2, where for clarity of the drawing only the axes of these tubes have been depicted, the latter are uniformly spaced apart and emerge in the vicinity of a curved surface $\mathbf{5}_1$ of an elongate component 5, the presence of which in the device constitutes an essential characteristic of the present invention. A linear spray unit is known, in fact, from the aforementioned international patent application, which includes means for supplying water to a spray nozzle and chambers which are adjacent to this nozzle and are connected to a source of pressurized air in order to spray the feed water into the nozzle. However, this known spray unit does not comprise members such as this elongate component and therefore does not afford the advantages that stem therefrom and which will be described later.

The elongate component 5 has the shape of a strip having, in addition to its convex surface $5_1$, two other contiguous surfaces $5_2$,$5_3$ which complete its outer surface and which can be seen in FIG. 3. In this figure, it is apparent that these surfaces are hollowed out with notches, respectively referenced $6_2$,$6_3$, these notches being uniformly distributed along the entire length of the component, these notches $6_2$ of one surface $5_2$ being lontigudinally offset from the notches $6_3$ of the other surface $5_3$.

In the position depicted in FIG. 1 of this elongate component or strip 5, the surfaces $5_2$,$5_3$ face respectively parts of the internal wall of the chamber 1 which are adjacent to a spray nozzle 7 cut out in that wall of the chamber 1 which is opposite that closed off by the pipe 4. The surfaces $5_2$,$5_3$ are some distance away from these parts of the wall so as to delimit slits, respectively $8_1$,$8_2$, via which the gas and liquid which are injected into the chamber can leave the latter via the spray nozzle 7 onto which the two slits converge.

Returning to FIG. 3, it may be observed that the notches $6_2$,$6_3$ have, along the longitudinal axis of the elongate component 5, a fixed width equal to that of plane surface elements which separate them, the notches of one of the surfaces of the elongate component being longitudinally offset from the notches of the other surface of this component, by the width of the plane surface element. Incidentally, it will be noticed that these notches have the shape of cavities with an incurvate bottom.

The operation of the device according to the invention is then set up as follows. With a liquid and a gas under pressure feeding, respectively, the pipes 4 and 2, the liquid flowing out of the ends of the tubes $3_1$ to $3_{17}$ sprays the elongate component 5 over the entire length of its convex surface $5_1$, which may, for example, be a cylindrical surface of revolution. The liquid then spreads out over this surface and follows the profile of its curvature by the Coanda effect before entering the slits $8_1$,$8_2$ with the injected gas which carries it away by viscous friction into the restriction delimited by the convex surface and the internal wall of the chamber. Two convergent sheets of a liquid/gas mixture are thus formed in these slits, these sheets interpenetrating, according to the invention, in the region of the spray nozzle 7 by virtue of the interlacing of the jets of greater section, and therefore of greater power, which are formed in the region of the cavities $6_2$ and $6_3$, these jets intersecting without significant coalescence because of the offset of the cavities $6_2$ and $6_3$. In fact, each jet, in the spray nozzle, opposes the "flat" jet of smaller section, and of lesser power, which faces it and then continues its progression substantially along its axis, thus maintaining, in the dihedron delimiting the liquid sprayed by the nozzle, a maximum angular spread $\alpha$.

By virtue of this large angular spread $\alpha$, it is possible to spray a large area with a spray device according to the invention and thus to limit the number of devices to be used to spray a given area, in accordance with one of the essential objectives of the present invention.

In the application mentioned above, in the cooling of blooms with the aid of the liquid mist emitted by the spray nozzle of the device according to the invention, this makes it possible to limit the number of devices to be used and therefore the complexity of the plumbing for supplying these devices and the cost of maintaining this plumbing.

Incidentally, it will be noticed that the notches $6_2$, $6_3$ could have shapes other than those of cavities with an incurvats bottom. Thus, these notches could have, for example, plane bottoms. Likewise, the surface elements separating the notches could have shapes other than plane shapes insofar as the sheet elements of the liquid/gas mixture which these separations delimit continue to have a smaller section than that of the sheet elements delimited by the notches.

By way of non-limiting example, it is possible to obtain a spray angle $\alpha$ of 60°, with a cooling liquid constituted by water and sprayed by a gas constituted by air, these fluids being delivered to the device under relative pressures of, respectively, 1 and 0.1 bar. The midplanes of the two slits define a dihedron of approximately 120° aperture. The width of the spray nozzle and of the slits is everywhere greater than 1 mm so as to avoid the clogging problems mentioned earlier. The radius of the cylindrical surface $5_1$ of elongate component 5 is 20 mm while the spacing of the tubes is 10 mm.

According to the present invention, the spray angle $\alpha$ of the liquid mist may be further increased by fitting a deflecting skirt 9 to the device, as depicted by the broken lines in FIG. 1. This skirt has an aperture angle calculated so that, by the Coanda effect which results from its presence, the liquid mist moves close to the inside wall of the skirt, increasing the mist spray angle which can then reach a value $\alpha'$ of approximately 90°, for example.

In addition to this large spray angle and the absence of clogging already mentioned, the device according to the invention has other advantages. In accordance with one of the objectives of the present invention, the flow rate can be controlled within an extremely wide range, which may be quantified by an extreme flow rate ratio greater than 10 and which may even reach 15, that is a flow rate ratio very much greater than those observed with the devices of the prior art for which this ratio only reaches 3 or 4. As has been seen earlier, this flexibility in fixing the flow rate makes it possible to install the device according to the invention at various points in a cooling installation for which the fluid flows necessary for cooling are very different. This results in great flexibility in the use of this device.

Using water supply tubes of small diameter (for example 2 mm in diameter) and of long length, it is possible to establish in these tubes a large frictional head loss which ensures uniform distribution of the water over the entire length of the elongate component 5 and therefore good uniformity of the liquid mist which leaves the spray nozzle of the device.

This uniformity also results from the mixing of highly inclined jets formed in the region of the notches with the flat jets formed between these notches and which are less inclined.

It will be noticed that the convex surface of the elongate component makes it possible to reduce any non-uniformity which could result from a defect in alignment of the water feed pipes.

By virtue of the backpressure applied by the air to the water contained in the tubes, these may be kept filled during a period when spraying has stopped. This filling reduces the time for repriming the device when the latter is started up again.

By fitting the elongate component 5 in such a way that it can be detached by axial extraction or else by adopting another mode of fitting, consisting in producing a removable spray nozzle which includes the elongate component 5 and the nozzle 7, it is easier to detach it and rapid access to the inside of the device is gained with a view to cleaning it, for example, or for replacing the elongate component with another component having a geometry suitable for obtaining other performance characteristics.

Needless to say the invention is not limited to the embodiment described and depicted and to the application mentioned, these being given solely by way of example. Thus, the device according to the invention may also be used for the cooling of aluminum sections or of large beams, or the spraying of liquids other than cooling liquids, such as varnish, paint, etc. Moreover, the device according to the invention could function with the spray nozzle having any orientation in space.

We claim:

1. Device for linear spraying of a liquid comprising a chamber, means for supplying the liquid to an elongate spray nozzle formed. in a wall of the chamber and means for injecting gas into this chamber in order to spray the liquid supplied to the nozzle and to carry it away out of the chamber, wherein an elongate component is arranged in the chamber so as to be sprayed by the liquid leaving the supply means and which then spreads out over a convex surface of this component in order to be carried away by said gas and to flow out towards two elongate slits adjacent to the nozzle and converging on the latter, these slits having a length and a width which varies periodically and complementarily along said length so as to delimit two sheets of the liquid/gas mixture which interpenetrate in the region of the nozzle, forming, at the outlet of the latter, a liquid mist confined within a dihedron opening out from the nozzle.

2. Device in accordance with claim 1, wherein each slit is delimited by an internal wall part of the chamber and a surface of the elongate component arranged opposite and which extends one end of the convex surface of this component, the two surfaces of the elongate component which each delimit one slit intersecting in the region of the spray nozzle.

3. Device in accordance with claim 2, wherein the said surfaces of the elongate component which delimit the slits are hollowed out with notches ($6_2$,$6_3$) distributed uniformly along the spray nozzle, the notches of one surface being longitudinally offset from the notches of the other surface.

4. Device in accordance with claim 3, wherein the notches along the longitudinal axis of the elongate component have a fixed width equal to that of plane surface elements separating them, the notches of one of the surfaces of the elongate component being longitudinally offset from the notches of the other surface of this component by the width of these surface elements.

5. Device according to claim 4, wherein the notches have the shape of cavities with a curved bottom.

6. Device according to claim 4, wherein the notches have a plane bottom.

7. Device according to claim 1, wherein the surface elements separating the notches on the elongate component are plane.

8. Device according to claim 1, wherein the two slits have midplanes which define a dihedron of approximately 120° of aperture.

9. Device according to claim 1, wherein a deflecting skirt is fixed around the spray nozzle in order, by the Coanda effect, to increase the aperture angle ($\alpha$) of the dihedron within which the nozzle sprays the liquid.

10. Device according to claim 1, wherein the liquid supply means are constituted by a pipe arranged parallel to the spray nozzle, this pipe feeding a series of parallel tubes fitted perpendicularly on the pipe and emerging in the vicinity of the curved surface of the elongate component.

11. Device according to claim 1, wherein the liquid is water and the gas is air, both being fed under low pressure.

* * * * *